United States Patent [19]

Tissot et al.

[11] 3,987,556

[45] Oct. 26, 1976

[54] APPARATUS FOR DRYING HIDES AND SKINS

[76] Inventors: Olivier Tissot, Saint Mury, Meyland (Isere); Irenee Catalo, Avenue de L'Egalite, Graulhet (Tarn), both of France

[22] Filed: Apr. 17, 1973

[21] Appl. No.: 351,988

[30] Foreign Application Priority Data

Apr. 26, 1972 France ..... 72.15764

[52] U.S. Cl. ..... 34/155; 34/217; 34/162

[51] Int. Cl.[2] ..... F26B 13/10

[58] Field of Search ..... 34/DIG. 16, 17, 18, 34/23, 34, 40, 41, 68, 155, 162, 39, 4, 210, 212, 217

[56] References Cited

UNITED STATES PATENTS

| | | | |
|---|---|---|---|
| 2,299,725 | 10/1942 | Argabrite | 34/23 |
| 2,405,813 | 8/1946 | Blanchard | 34/155 X |
| 3,119,354 | 1/1964 | Gawlitza et al. | 34/4 X |
| 3,241,247 | 3/1966 | Baker | 34/17 |
| 3,321,842 | 5/1967 | Bocciardo | 34/162 X |
| 3,791,049 | 2/1974 | Smith, Jr. | 34/18 X |

FOREIGN PATENTS OR APPLICATIONS

| | | | |
|---|---|---|---|
| 1,139,439 | 11/1962 | Germany | 34/39 |
| 366,571 | 2/1932 | United Kingdom | 34/DIG. 16 |

*Primary Examiner*—Charles J. Myhre
*Assistant Examiner*—William C. Anderson
*Attorney, Agent, or Firm*—Dowell & Dowell

[57] ABSTRACT

The present invention relates to a novel process for drying articles with low dimensional stability such as animal skins and hides and to apparatus for carrying it out.

The drier designed to carry out the above-mentioned process comprises in combination:

- at least one support on which the articles to be dried are placed;
- at least one chamber provided with irradiation means;
- at least one chamber of known type comprising means for circulating air, the said chamber having means in its lower portion for extracting damp air; and
- means for conveying the support through the above-mentioned chambers.

6 Claims, 2 Drawing Figures

APPARATUS FOR DRYING HIDES AND SKINS

DESCRIPTION OF THE INVENTION

The present invention relates to a novel process for drying articles with low dimensional stability such as animal skins and hides and to apparatus for carrying it out.

The improvements which form the object of the present invention are more particularly intended to enable hides and skins to be dried in good conditions while retaining optimum values for each of their dimensions.

The process in accordance with the invention is characterized by the fact that it consists of heating the flesh side of the articles, arranged flat on a support, in the open air, with their epidermal surfaces in contact with this support, and of subjecting the said articles to a hot air current with a predetermined absolute humidity in a closed chamber in such a manner as to cause, at the hair side, condensation of part of the moisture from the skin to wet the hair side of the skin and to leave the hair side of the skin in contact with that condensed moisture.

In accordance with a preferred embodiment of the above-mentioned arrangement, between two successive chambers is inserted a further chamber in which means are provided for emitting radiation causing thermal effects such that the articles are alternately exposed to radiation and to air currents, the characteristics of which are determined as a function of the required state of the articles at any instant of the drying cycle, these characteristics being especially chosen so as to cause condensation of a portion of the moisture at the hair side of the skin and to leave the hair side of the skin in contact with the water formed by such condensation.

In accordance with a modification, the articles to be dried are deep-frozen immediately after their application to the flat support and before their passage into the successive chambers. Improved drying as a result of deep freezing is claimed for certain types of skin.

The drier designed to carry out the above-mentioned process comprises in combination:

- at least one support on which the articles to be dried are placed;
- at least one chamber provided with irradiation means;
- at least one chamber of known type comprising means for circulating air, the said chamber having means in its lower portion for extracting damp air;
- means for conveying the support through the above-mentioned chambers.

The attached drawings, which are presented by way of example, will lead to a better understanding of the invention:

Figure 1:
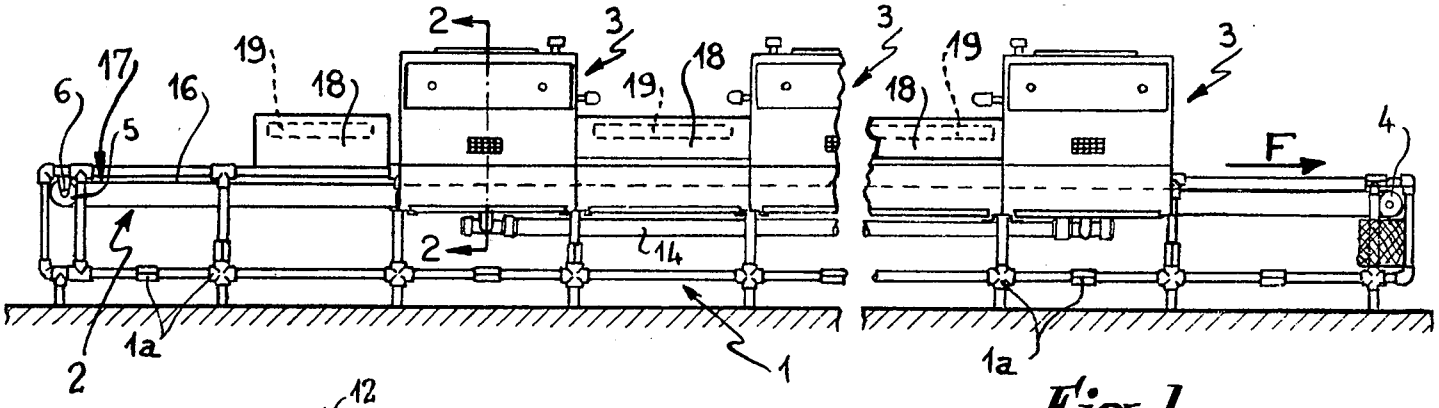
FIG. 1 is a general view of the drier in accordance with an embodiment of the invention.
Figure 2:
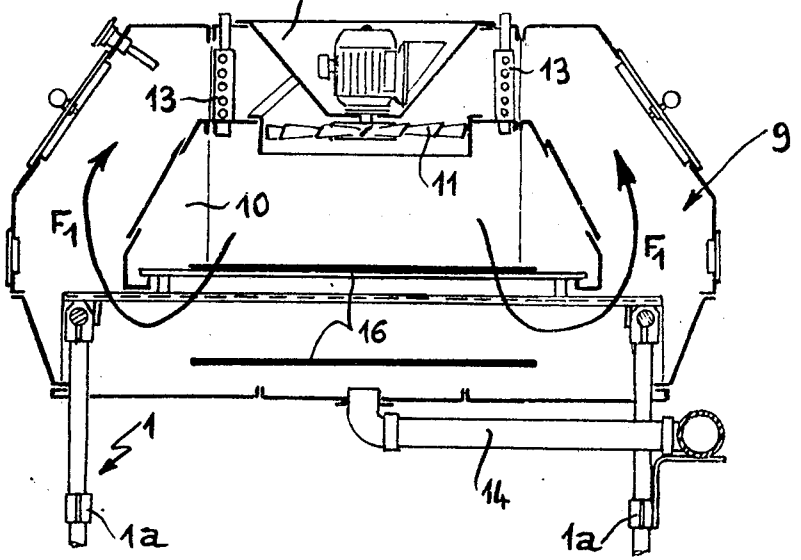
FIG. 2 is a cross sectional view to a larger scale taken along line 2—2 of FIG. 1.

The drier shown in FIG. 1 essentially consists of a frame 1 made of pipes assembled with suitable sleeves 1*a*, of an endless funicular organ 2 and of a certain number of impingement driers 3 arranged at long intervals along frame 1.

The funicular organ, for example comprising a metallic band 16 preferably made of a material having thermal inertia such as stainless steel, passes on the one hand around a drum 4 rotated by a propulsive unit with variable speed (not shown) and on the other hand around a drum 5 mounted freely on a shaft 6, so that this band continuously moves in the direction of arrow 1. According to another form of the funicular conveyor member, it comprises a roller chain. Certain of the links of the above-mentioned chain are rigidly connected to support plates, for example by means of a clevis 2*b* in which the two axes 2*b* of these links are engaged. These plates are made of a material having the same qualities as the metal conveyor belt 16. It will be understood that the support-plates, being made of a rigid material, e.g. metal, are rigidly attached to chain 2. Of course, slides (not shown) are provided to keep the plates horizontal.

The impingement driers (FIG. 3) are in the form of a chamber 9 closed by panels of heat-insulated steel plate. These panels are easily detachable. Inside chamber 9 has been placed a fan box 10, the upper portion of which carries a fan 11 with a high flow rate. This fan aspirates from outside through an upwardly open shroud 12.

The conveyor belt 16, or the chain fitted with its plates passes through each drier 3 at the base of fan box 10.

The air current impelled by the fan is projected towards the base of the said box and a portion of this current rises back between the latter and the panels of chamber 9 in the direction of arrows F1 to pass between heating elements 13 situated on either side of shroud 12, while a reduced pressure or vacuum extraction casing 14 opens into the bottom of chamber 9.

It will be noted, however, that the fan 11, instead of being above belt 16, could be immediately above the mouth of conduit 14, so that the drier would no longer be of the impingement type, but of the reduced pressure or vacuum type.

The heating elements may be of the aerothermal steam or electric type.

The above description of impingement driers 3 has been voluntarily limited to the elements which will enable the operation to be understood, since such driers are generally well known in the drying art.

Immediately before drier 3 and around belt 16 has been arranged a chamber 18 containing emitters 19 for producing radiation such as infra-red radiation. These emitters operate with electricity, gas or fuel-oil. A chamber 18 is preferably arranged around each drier 3.

The operation of the drier will now be described. The funicular conveyor 16 is displaced in the direction of the arrow F. The article to be dried is arranged on the upper run of belt 16, i.e. in a zone 17 situated immediately after drum 5. The article to be dried is applied hard against belt 16, by hand or by a suitable mechanism (not shown), and is placed thereon so that the epidermic side of the skin is against the conveyor band or belt 16. When the article to be dried enters the first radiation chamber 18 the infra-red radiation from the radiators 19 produces a rise in the temperature on the flesh side which produces a continuous evaporation of moisture coming from the skin. Part of this moisture thus evaporated is condensed again on the conveyor belt 16 next to the hair side of the skin. Another part of the moisture goes out of the chamber above the conveyor. It will be understood that the aforementioned condensation prevents the skin from curling up as it traverses through the impingement drier 3. The mechanisms by which the water acts on the skin at the surface are complex.

It is believed that the aforementioned condensation makes the skin adhere better to the conveyor belt in such a way as to prevent it from being curled up under the effect of the current of hot air in the drier chamber 3. This condensation action on the belt at the hair side of the skin occurs in each of the irradiation chambers 18. The intensity of the radiation, i.e. the thermal effect of the infra-red radiation emitted by the source, is regulated as a function of the hygrometric state of the skin at the outlet of the air current chamber 3 preceeding the next irradiation chamber 18 in such a way as to promote the condensation of part of the moisture at the belt 16 on the hair side of the skin.

The conveyor belt then passes sequentially through the several impingement driers 3 in which the current of hot air having a high flow rate causes the rapid but progressive elimination of the excess interfibrillar humidity through the "dermal" surfaces of the skins.

Given that the humidity of the atmosphere of the impingement driers is strictly controlled by any suitable means, the fibrillar humidity can be retained in the skins which is necessary to their proper treatment.

As the humid air which is produced in driers 3 tends to be situated adjacent to the bottom of their chambers 9, it is aspirated into extraction casing 14, which is under reduced pressure or vacuum.

It is self-evident that the characteristics of the atmosphere inside chambers 3 are determined as a function of the desired state of the skins at the outlets of these chambers.

A dried skin is obtained with the drier in accordance with the present invention in an infinitely shorter time (of the order of 60 to 100 times less) than the normal drying time for skins in the open air. Moreover, the articles thus obtained are practically flat and have an excellent "grain-side" appearance. These latter features avoid the renovating operations usually necessary on a skin dried in the air, so that the cost of drying is reduced in very considerable proportions.

We claim:

1. A drier for drying articles of low dimensional stability such as hides and skins by heating the articles while supporting them upon their epidermal surfaces and then subjecting them to hot air currents of predetermined humidity, comprising:

at least one non-porous support on which the articles to be dried are arranged on their epidermal surfaces;

means for heating said support prior to arrangement of the articles thereon;

at least one impingement chamber having means for passing a current of pressurized air thereinto and directing the air upon the unsupported surfaces of the articles at a high flow-rate, other means for heating this current of air, a casing situated at the base of said chamber below the support to extract the damp air contained in the chamber, and an outlet tunnel from the chamber; and means for conveying the support into the chamber.

2. A drier as described in claim 1, which comprises a plurality of supports in the form of plates rigidly connected to a funicular member which passes through the chambers at variable speed.

3. A device for drying articles of low dimensional stability such as hides and skins by heating the articles while supporting them upon their epidermal surfaces and then subjecting them alternately to irradiation and to hot air currents of predetermined humidity, comprising:

at least one pre-heated support on which the articles to be dried are placed on their epidermal surfaces;

at least one chamber provided with irradiation means;

at least another chamber having means for circulating hot air therethrough and impinging the air on the unsupported surfaces of the articles, said chamber having means in its lower portion for extracting damp air;

and means for conveying the support through the above mentioned chambers.

4. A drier as set forth in claim 3 wherein the support consists of an endless conveyor belt of polished stainless steel.

5. A drier as described in claim 3 wherein the chamber in which the air is circulated is of the impingement type.

6. A drier as described in claim 3 wherein the chamber in which the air is circulated is of a reduced-pressure type.

* * * * *